US010352000B2

(12) United States Patent
Raymond

(10) Patent No.: US 10,352,000 B2
(45) Date of Patent: Jul. 16, 2019

(54) BAND FOR RAILWAY TRACK BLOCK AND BOOT COMBINATION

(71) Applicant: Russell Raymond, Wexford, PA (US)

(72) Inventor: Russell Raymond, Wexford, PA (US)

(73) Assignee: Construction Polymers Technologies, Inc., Wexford, PA (US)

( * ) Notice: Subject to any disclaimer, the term of this patent is extended or adjusted under 35 U.S.C. 154(b) by 560 days.

(21) Appl. No.: 15/141,194

(22) Filed: Apr. 28, 2016

(65) Prior Publication Data

US 2017/0314208 A1 Nov. 2, 2017

(51) Int. Cl.
*E01B 3/40* (2006.01)
*E01B 1/00* (2006.01)

(52) U.S. Cl.
CPC ..... *E01B 3/40* (2013.01); *E01B 1/005* (2013.01); *E01B 2204/01* (2013.01)

(58) Field of Classification Search
CPC ..... E01B 3/28; E01B 3/38; E01B 3/40; E01B 1/005; E01B 2204/01
See application file for complete search history.

(56) References Cited

U.S. PATENT DOCUMENTS

| | | | |
|---|---|---|---|
| 4,266,719 A | 5/1981 | Ortwein et al. | |
| 4,489,884 A | 12/1984 | Harmsen | |
| 4,609,144 A | 9/1986 | Harmsen | |
| 5,008,317 A | 4/1991 | Wolfer et al. | |
| 5,147,705 A * | 9/1992 | Lin | A41F 19/00 2/336 |
| 5,713,517 A | 2/1998 | Loison | |
| 5,725,149 A | 3/1998 | Goossens | |
| 6,122,779 A | 9/2000 | Meili et al. | |
| 6,283,383 B1 | 9/2001 | Blank et al. | |
| 6,364,214 B1 | 4/2002 | Sonneville et al. | |
| 7,832,930 B2 | 11/2010 | Geka et al. | |
| 2007/0200005 A1 | 8/2007 | Corbett, Jr. et al. | |
| 2008/0083835 A1 | 4/2008 | Girardi et al. | |

FOREIGN PATENT DOCUMENTS

| | | |
|---|---|---|
| AU | 1994079073 | 7/1998 |
| EP | 0655529 B1 | 5/1995 |
| EP | 0557870 A1 | 5/1996 |
| FR | 2648489 A1 | 12/1990 |
| JP | 7247503 A | 9/1995 |

(Continued)

OTHER PUBLICATIONS

Non-Black Fillers for Elastomers (NBFE) (Year: 2009).*

(Continued)

*Primary Examiner* — Mark T Le
(74) *Attorney, Agent, or Firm* — Fay Sharpe LLP

(57) ABSTRACT

A band adapted for use as a seal around an upper edge of a boot adapted for holding a block to which a rail is fastened, includes an elongated body having an outer face, an inner face, a first end and a second end. The first and second ends of the elongated body are secured to each other to form the band. An inner face of the elongated body is smooth and an outer face thereof includes a plurality of laterally spaced ribs. The ribs extend from the first end of the band to the second end thereof. The elongated body is made from an electrically insulating elastomeric material.

11 Claims, 9 Drawing Sheets

(56) References Cited

FOREIGN PATENT DOCUMENTS

| | | | |
|---|---|---|---|
| JP | 9310301 | A | 12/1997 |
| KR | 10-2011-0089991 | | 8/2011 |
| WO | WO 2013/036120 | A1 | 3/2013 |

OTHER PUBLICATIONS

BSI Standards Publication, "Railway Applications—Track—Test Methods for Fastening Systems, Part 5: Determination of Electrical Resistance", © 2012.
Lindemuth, Dale P.E., et al., "Light Rail Transit Stray Current Control: How Much Water Line Protection is Really Needed?", Corrpro Companies, Inc., 18 pages, before May 2016.
Sonneville, "Low Vibration Track System (LVT)—System Advantages", 3 pages, Jan. 2011.
Tupta, Mary Anne, "Measuring the Resistivity of Bulk Materials", Electronic Engineering Times, pp. 21-24, Jan. 2011.
http://elteklabs.com/test-capabilities/material-properties-testing/electrical-properties/, "Electrical Properties", 4 pages, Oct. 26, 2015.
http://trid.trb.org/view.aspx?id.486797, "Control of Stray Current on the Marta Rail System", 2 pages, Nov. 12, 2015.
http://www.sonneville.com/en/low-vibration-track-lvt/, Sonneville, "Low Vibration Track (LVT)", 2 pages, Oct. 13, 2015.

* cited by examiner

BAND FOR RAILWAY TRACK BLOCK AND BOOT COMBINATION

BACKGROUND

The present disclosure pertains to a band for sealing between a boot and a block or tie which supports a rail of a railway track system.

Light rail, metro and subway lines around the world have recently been equipped with various non-ballasted track systems in order to reduce maintenance costs and to enhance performance. Many of these systems comprise a block or tie generally made of precast concrete. The block or tie is often held in a rubber boot with a resilient elastomeric pad placed between the base of the block or tie and the base of the boot. The boot is then encased in concrete or grout. The rubber boot is advantageous in that it allows deflection of the block under dynamic loads. It is also known to place a rail pad between the bottom of the rail and the top of the concrete block. The rail pad is helpful in mitigating the effects of higher frequency vibrations, whereas the resilient pad placed between the bottom of the concrete block and the bottom of the rubber boot serves to mitigate the influence of low frequency vibrations. Further information concerning such systems can be found in U.S. Pat. No. 6,364,214, the contents of which are incorporated by reference hereinto in their entirety.

It is also known to seal between the rubber boot and the block in order to retard the ingress of water and other fluids into the boot because such fluids could give rise to damage to the block, the boot, or both. To this end, it is known to position a band surrounding the top margin of the boot so as to provide a seal between the boot and the concrete block.

However, the known band is not optimized for retarding stray current from flowing between the rails on which the light rail carriage moves and the electrified third rail which powers the movement of the railway carriage. Stray current corrosion has been found to be a significant problem with direct current powered transit systems. In such systems, the railway carriage can be powered by, for example, 750 volts DC traction power supplied to the railway carriage through a pickup shoe in contact with a third rail located to the side of the track. The negative return from the car is through the car wheels and to the running rails. Thus, the running rails, which are supported on blocks encased in boots, are the primary source of the stray current.

Therefore, it is desirable to minimize the flow of stray electrical current through the running rails of the railway carriage. It would be desirable if the electrical isolation of the running rails from the ground is maximized. To meet these objectives, it would be desirable to provide a band encircling the joint between the rubber boot and the concrete block, which band maximizes the electrical isolation of the running rails in relation to the ground surface.

BRIEF SUMMARY

A band adapted for use as a seal around an upper edge of an associated boot adapted for holding an associated block to which one or more associated rails are fastened. The band comprises an elongated body including an outer face and an inner face, a first end and a second end. The first and second ends of the elongated body are secured to each other. The inner face of the elongated body is smooth and the outer face thereof includes a plurality of laterally spaced ribs extending from the first end of the band to the second end of the band. The elongated body comprises an electrically insulating elastomeric material.

In accordance with another embodiment of the present disclosure, provided is a band adapted for use as a seal around an upper edge of a boot which is adapted for holding an associated block to which one or more associated rails are fastened. The boot comprises a first type of elastomeric material. The band comprises a second type of elastomeric material. The band includes an elongated body having an outer face, an inner face, a first end and a second end, wherein the first and second ends of the elongated body are secured to each other. The inner face of the elongated body is smooth and the outer face thereof includes a plurality of laterally spaced ribs extending from a first end of the elongated body to a second end thereof. The elongated body comprises a base elastomer of Ethylene Propylene Diene Terpolymer with a non-carbon type mineral filler which provides a volume resistivity of about $1.34\times10^{14}$ Ωcm.

BRIEF DESCRIPTION OF THE DRAWINGS

The disclosure may take physical form in certain parts and arrangements of parts, several embodiments of which will be described in detail in this specification and illustrated in the accompanying drawings which form a part hereof and wherein.

DETAILED DESCRIPTION

Figure 1:
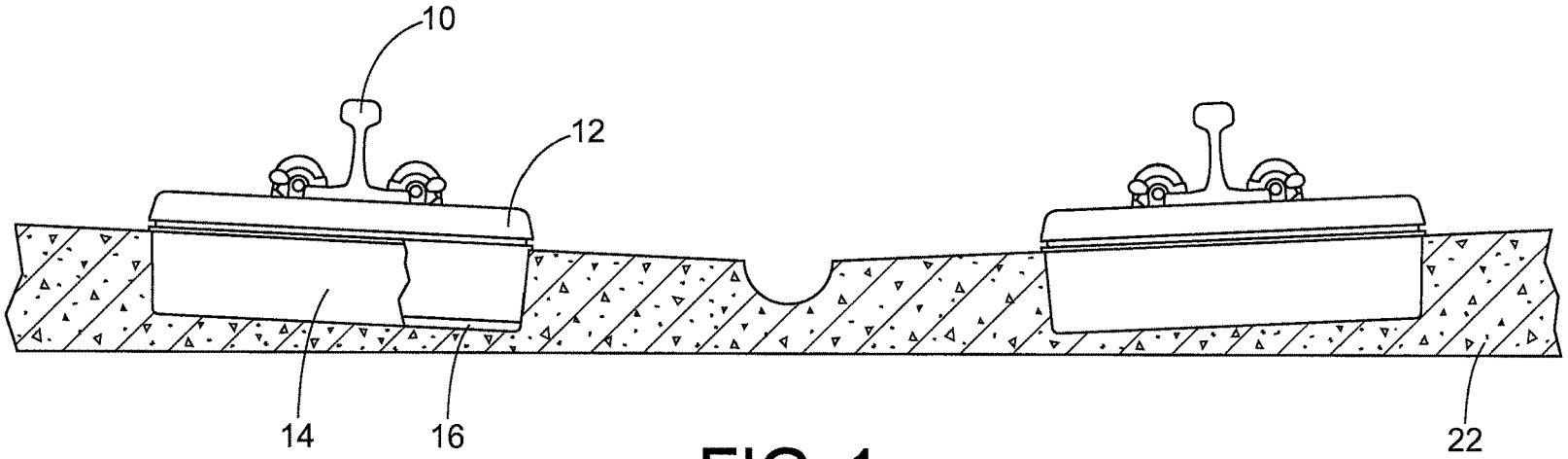
FIG. 1 (PRIOR ART)
FIG. 1 is a cross sectional view of a conventional non-ballasted track system.

While the instant disclosure is susceptible of embodiment in many different forms, there are shown in the drawings and will herein be described in detail several embodiments of the disclosure. However, it should be understood that the Figures are to be considered only as exemplifying the principles of the instant disclosure and are not intended to limit the disclosure to the embodiments illustrated herein.

FIG. 1 shows a light railway track 10 that is supported on a pre-cast concrete block 12 which in turn is mounted in an elastomeric boot 14 above an elastomeric pad 16 that is disposed between the bottom of the block and the bottom of the boot. The boot 14 is, in turn, held in a mass of concrete or grout, such as unreinforced concrete. It is apparent from FIG. 1 that two such rails are provided for a known type of light railway carriage which is electrically powered via a third rail (see FIG. 9).

Figure 2:
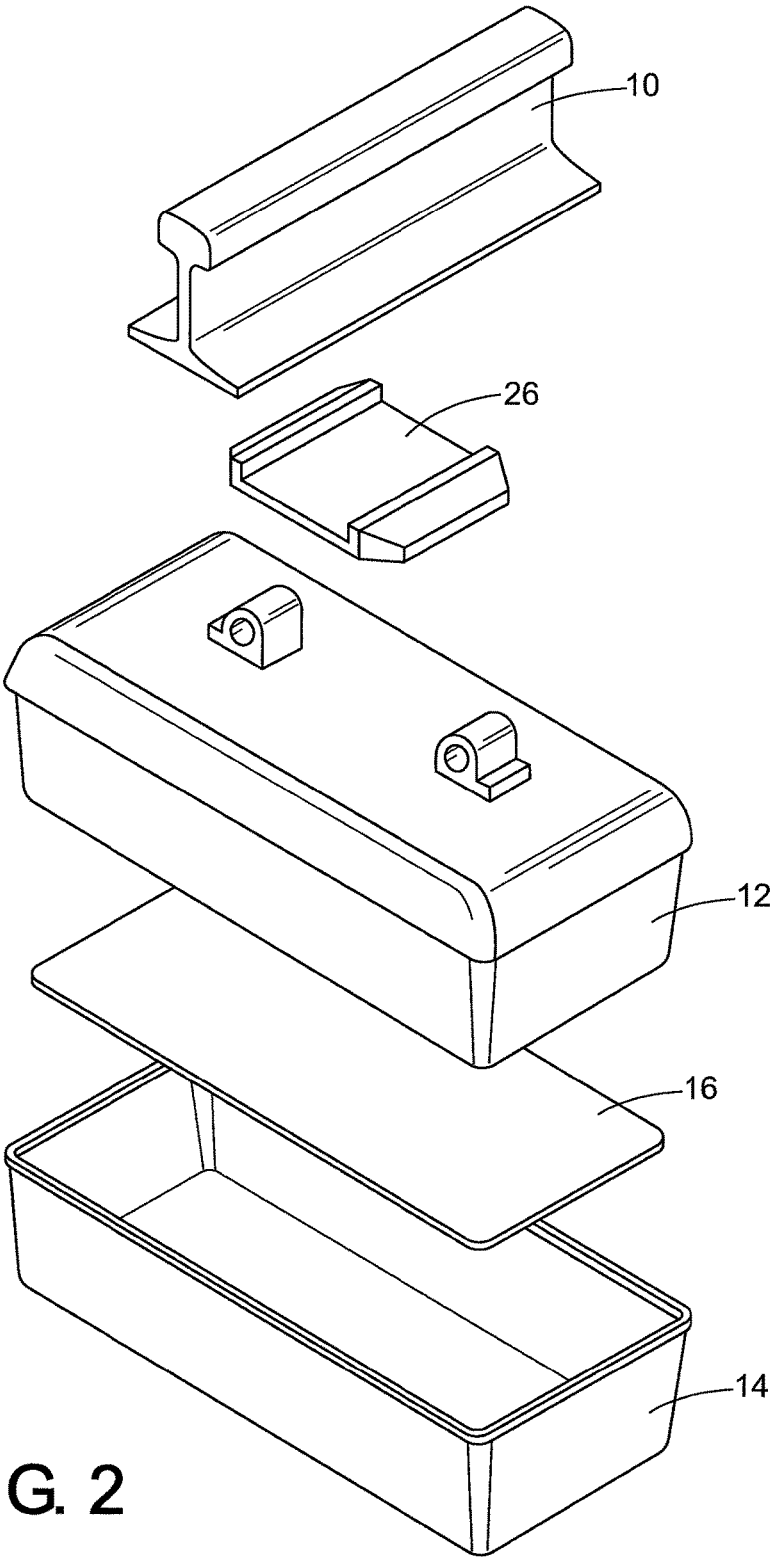
FIG. 2 is an enlarged exploded perspective view of a portion of the system of FIG. 1.

With reference now also to FIG. 2, it is known to provide an elastomeric rail pad 26 disposed between a bottom of the rail 10 and a top of the block 12. The pad 26 is resilient, as is the pad 16. The pad 16 provides for load distribution analogous to a ballasted track and reduces the influence of low frequency vibrations. The pad 26 protects against the effects of higher frequencies. The rubber boot 14 allows for unhindered deflection and, under dynamic loads, provides very low system stiffening, presuming that the pad 16 is of adequate quality.

Figure 3:
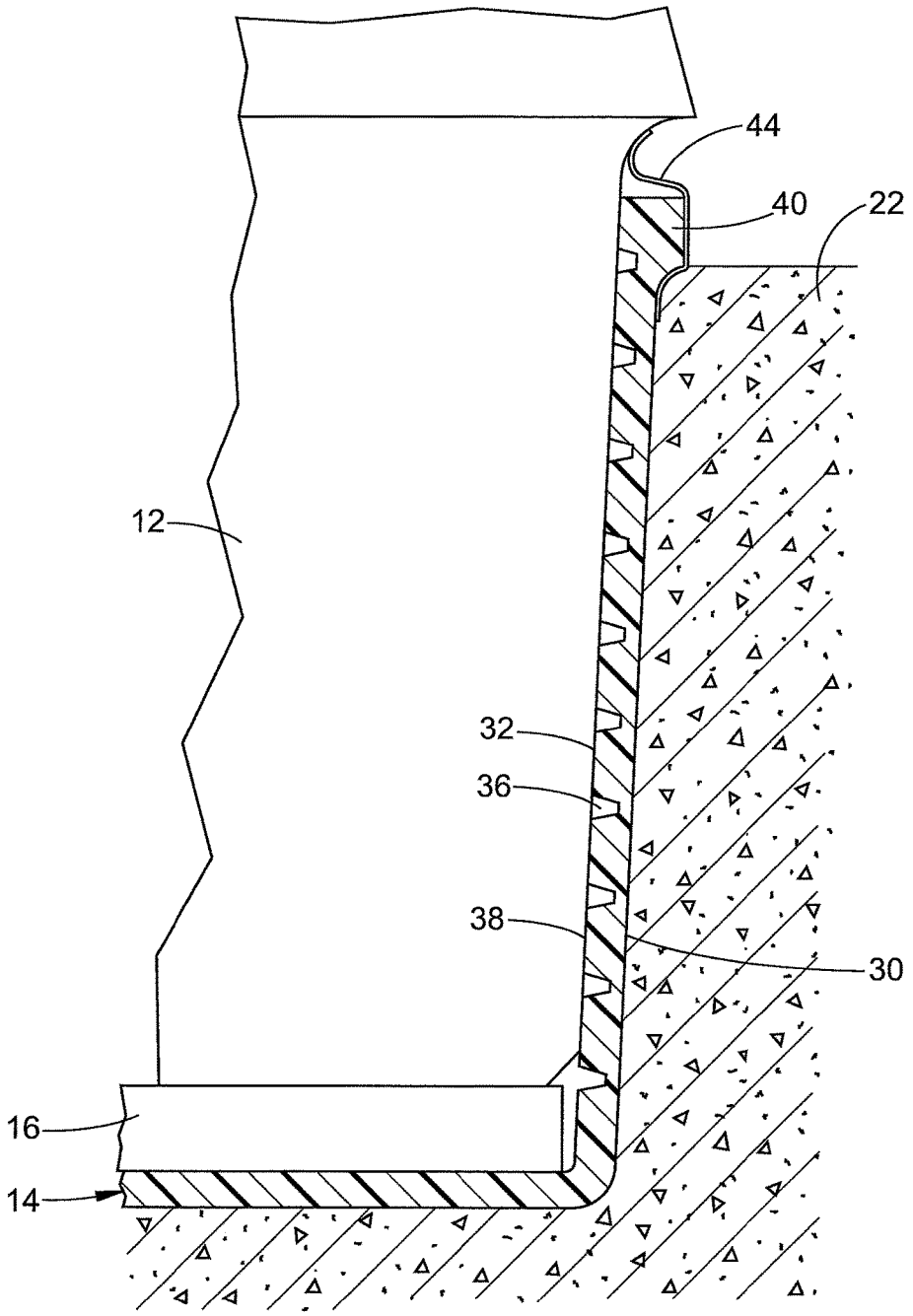
FIG. 3 (PRIOR ART)
FIG. 3 is a greatly enlarged assembled cross sectional view of a portion of a boot, a pad and a block of FIG. 2.

With reference now to FIG. 3, it can be seen that the boot 14 can have a flat outer surface 30 and a serrated inner surface 32 in which are defined a plurality of spaced longitudinally oriented grooves 36. Ribs 38 are disposed between the grooves 36. The boot is generally sunk into the concrete or grout up to the level of a lip 40 defined on the upper end of the boot 14. During transport, it is conventional to secure a tape to the construction. In one embodiment, a tape 44 extends over the lip 40 and up a portion of the block 12, so as to retard moisture from seeping into the boot.

Figure 4:
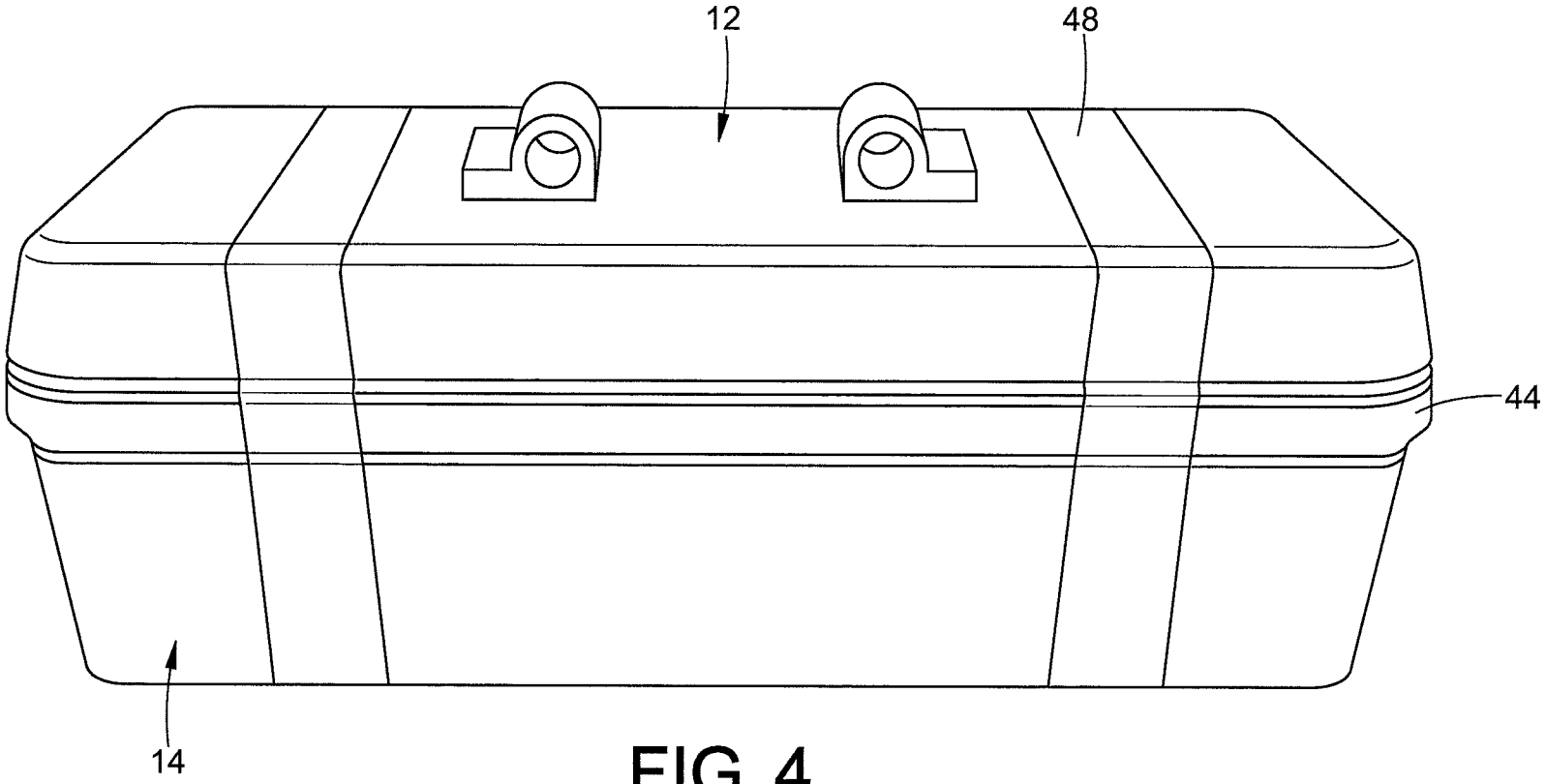
FIG. 4 (PRIOR ART)
FIG. 4 is a perspective view of a conventional boot and block in a shipping configuration.

With reference now also to FIG. 4, during transport of the block and boot assembly, not only is there a horizontally extending tape 44 often used between the lip of the boot and the adjacent portion of the concrete block, but also vertically extending straps 48 may be provided in order to keep the block 12 and boot 14 connected to each other. Both the strap 48 and the tape 44 are subsequently removed during the process of mounting the block and boot package in the concrete or grout.

Figure 5:
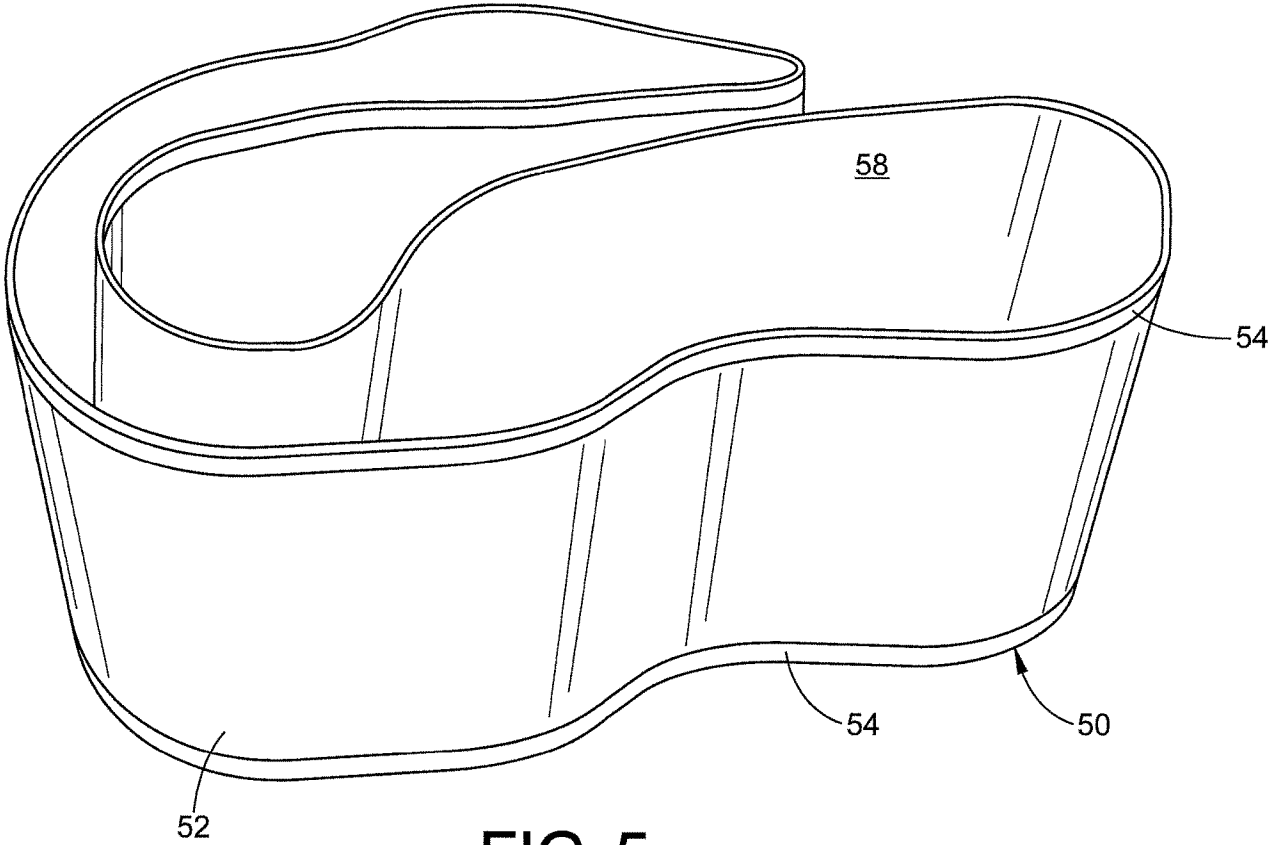
FIG. 5 (PRIOR ART)
FIG. 5 is a perspective view of a known band.

Previously, it has been known to provide a band 50 for sealing between the lip of the boot and the adjacent portion of the concrete block as shown in FIG. 5. The known band includes a flat outer surface 52, on which can be disposed at least one marker line 54, and a flat inner surface 58. It should be apparent from FIG. 5 that in this embodiment two such marker lines 54 are disposed on opposing edges of the outer surface of the band. The purpose of the marker lines is to indicate the depth to which the concrete or grout should be poured around the band once the boot and block package with the band in place has been correctly located. The known band can be made of a flexible and elastically deformable material. It is meant to ensure sealing between the block and the boot, thereby retarding the ability of moisture to penetrate into the boot. Ideally, a water tight seal is provided by the band between the boot and the block.

A problem with such known bands is that they do not provide adequate electrical resistance, i.e., resistance to stray current flow between the rail supported by the block and the surroundings.

Figure 6:
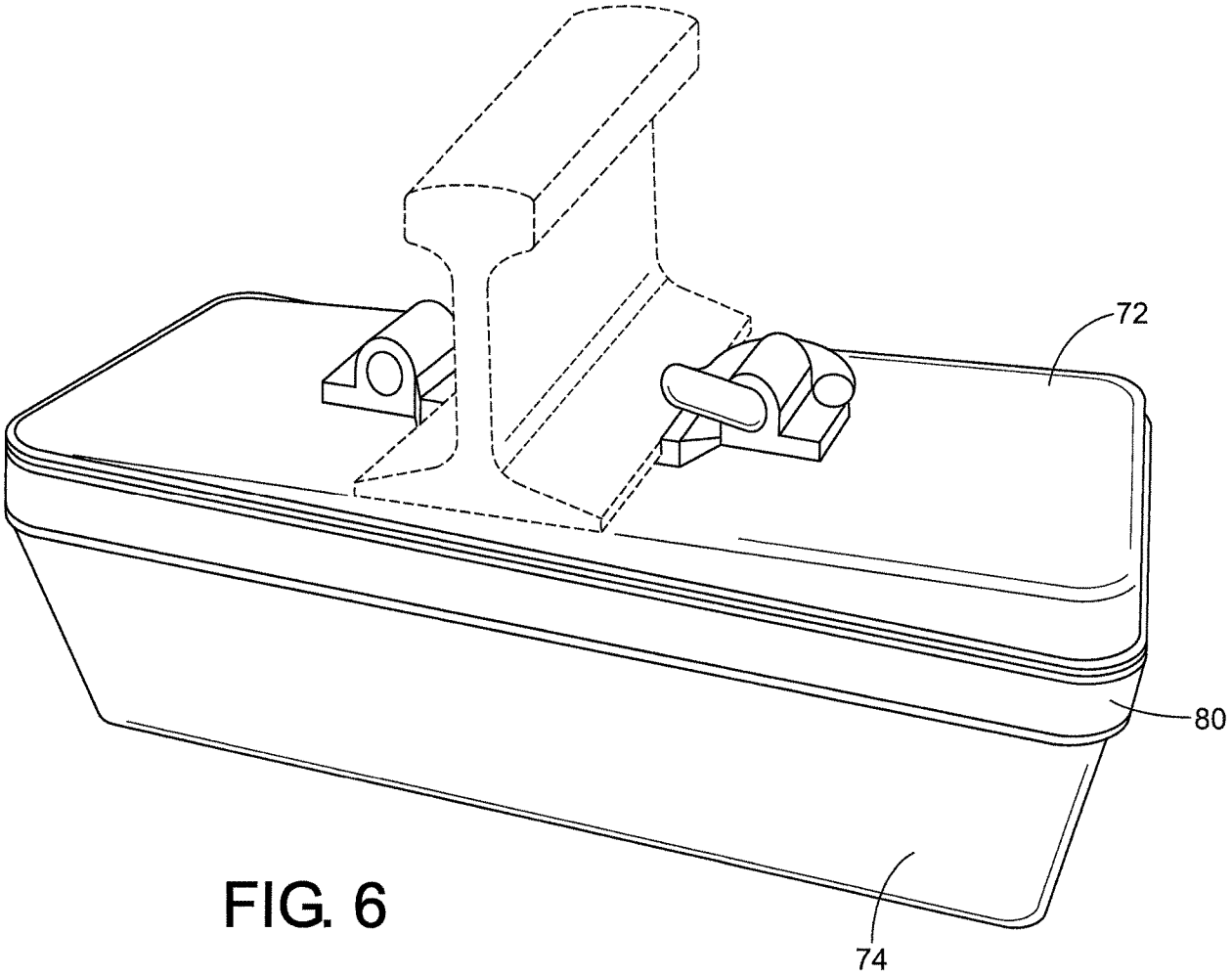
FIG. 6 is a perspective view of a band mounted to a boot and block according to one embodiment of the present disclosure.

With reference now to FIG. 6, in one embodiment of the present disclosure, there is provided a block 72 which is supported in a boot 74. In this embodiment, the block 72 has an upper surface which is angled at an acute angle in relationship to a horizontal plane. A block with such a configuration is useful for accommodating a section of curved track as is well-known in the art. The disclosure further comprises an elastomeric band 80 that stretches around a lip of the boot 74 and contacts an adjacent portion of the block 72 so as to retard a flow of water or the like fluid into the boot 74. At the same time, the band 80 is configured to better electrically isolate the concrete block from its environment. Better isolation of the concrete block reduces the amount of stray current flow from the track which is supported by the concrete block.

Figure 7:
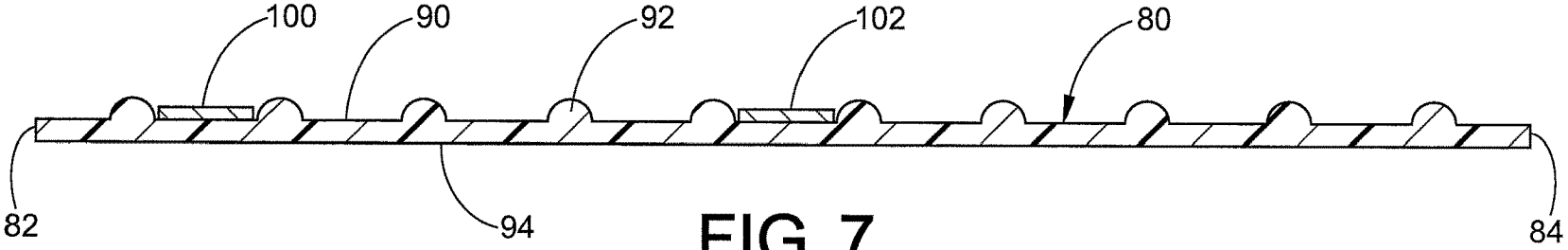
FIG. 7 is a greatly enlarged cross sectional view of a portion of the band of FIG. 6.

With reference now also to FIG. 7, in a greatly enlarged cross-sectional view of one embodiment of the band, as placed on its back, the band 80 comprises a first or upper side edge or top edge 82, a second or lower side edge 84 or bottom edge and an outer surface 90. Disposed on the outer surface are a plurality of spaced, aligned longitudinally extending ribs or protrusions 92. In this embodiment, a plurality of equally spaced ribs 92 are disposed along a height of the band, i.e., from its bottom edge to its top edge as it is disposed during use (see FIG. 6). The ribs 92 can extend the length of the band so that the ribs defined on the band will encircle the block and boot joint shown in FIG. 6. To this end, the ribs can extend continuously from one end of the band 80 to its other end, with the two ends joined together as is well known in the art. In this embodiment, there is also provided a first marker line 100 disposed between two adjacent ones of the ribs 92, with the marker line located adjacent an upper end 82 of the band. A second marker line or stripe 102 can be provided on the outer surface of the band between a pair of adjacent ribs located nearer to the center of the height of the band as disposed on the boot.

In the embodiment of FIG. 7, the ribs 92 are illustrated as being approximately semicircular in cross-section with a height of each of the ribs being approximately equal to the thickness of the band 80. In one embodiment, the band can have a thickness of 1.19 mm (0.046 inches). If the ribs 92 are of approximately the same thickness, the height of the band at the location of the ribs can be on the order of 2.38 mm (0.094 inches). In contrast, the boot can, in one embodiment, be about 4.72 mm in thickness. In another embodiment, the band can have a thickness of between 0.45 and 0.55 inches (1.14 to 1.40 cm) and wherein a thickness at the apex of a rib is between 0.75 and 0.85 inches (1.91 to 2.16 cm).

In one embodiment, the boot can be made of a non-conductive compound such as styrene-butadiene rubber (SBR) and the band can be made of a non-conductive compound such as ethylene-propylene diene monomer (EPDM), which is a type of synthetic rubber. EPDM is also useful material because it has wide service temperature range. The range of service temperatures for EPDM can be from about 150° C. to about −50° C. Therefore, EPDM is a useful material for the foreseeable temperature range that the band would likely encounter in the field.

One variety of EPDM is called Ethylene Propylene Diene Terpolymer (EPT). A terpolymer is a copolymer consisting of three distinct monomers. In one embodiment, the dienes used in manufacturing EPT are dicyclopendiene (DCPD), ethylene norbornene (ENB) and vinylnorbornene (VNB). EPT is a synthetic rubber known for its superior ability to cope with various climatic conditions and its resistance to ozone, heat and cold. It also performs well as an electric insulator and is known for its chemical resistance. EPT has high elasticity and tensile strength and maintains its flexibility at low temperatures.

The durometer of such an EPT band can be on the order of 60 on the Shore A hardness scale. The EPT material can have a tensile strength of about 1366 PSI; an ultimate elongation of 617 percent; a 100 percent modulus of 256 PSI; a 200 percent modulus of 315 PSI; and a 300 percent modulus of 388 PSI. In one embodiment, the band was made from a synthetic rubber, namely, ethylene-propylene-diene terpolymer while utilizing a calcined aluminum silicate filler in order to increase the ultimate resistivity of the band material.

When a 500 volt DC charge (at 73° F. and 50% relative humidity) was applied to the band of FIG. 7 (1.19 mm thick) for one minute, the current flow for the band was $1.47\times10^{-9}$ A (amps) and, the resistance of the band was $3.41\times10^{11}\Omega$ (ohms). Thus, the resistivity of the band was measured to be $1.34\times10^{14}$ Ω*cm.

Unlike the EPT material of the ban band of FIG. 7, a boot, such as the boot of FIG. 6, is made of an SBR material. When a 231.1 DC charge was applied to the boot of FIG. 6 (4.72 mm thick) for one minute under the same test conditions, the resistance of the boot was $1.65\times10^4\Omega$ at a current of $1.4\times10^{-2}$ A. Therefore, the resistivity of the boot was only $1.73\times10^6$ Ωcm. The voltage applied to the boot was lowered due to the sample's lower resistivity. Thus, the resistivity of the boot is many orders of magnitude smaller than is the resistivity of the band.

The benefit of providing ribs located on the outer periphery or outer surface of the band is to increase the distance that current needs to flow between the block and the surroundings. While semicircular ribs 92 are illustrated in FIG. 7, it should be appreciated that a variety of other configurations of the ribs could be provided.

Figure 8A:
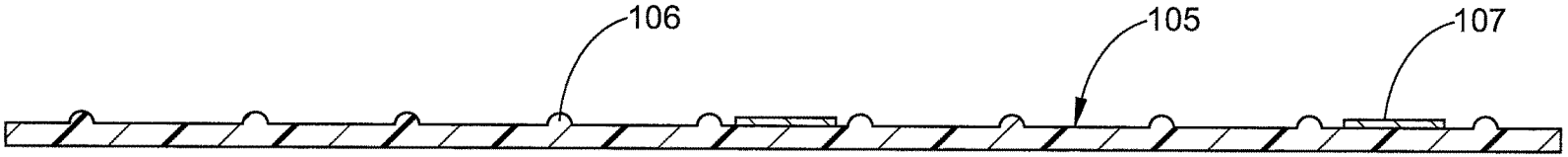
FIGS. 8A-8E are cross sectional views of several other embodiments of a band according to the present disclosure.

With reference now to FIGS. 8A-8E, illustrated there are a variety of similar bands with other configurations or types of ribs. More particularly, FIG. 8A illustrates smaller ribs extending or protruding from the band. In this embodiment, a band 105 is provided with ribs 106 which ribs are approximately half the thickness of the band. Thus, if the band has a thickness of 1.19 mm (0.046 inches), the ribs 106 have a thickness of about 0.6 mm (0.024 inches). It can be anticipated that with shorter ribs, the band will have less resistivity than would the band of the embodiment of FIG. 7. Also provided on the band is at least one stripe 107. The band can be made of the same material as outlined above in connection with the embodiment of FIG. 7.

Figure 8B:
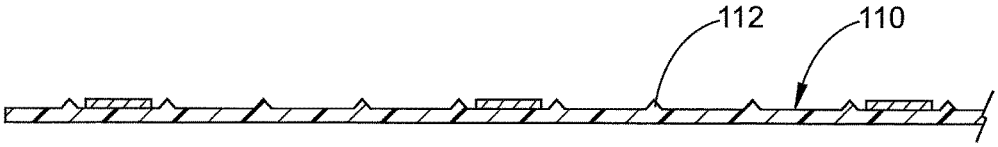
Figure 8C:
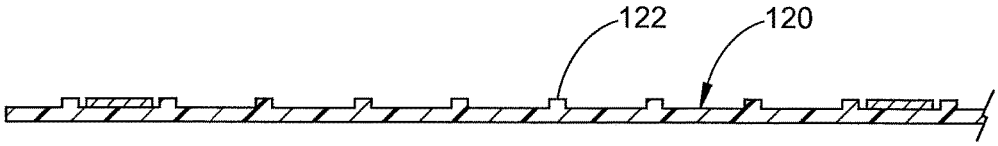
Figure 8D:
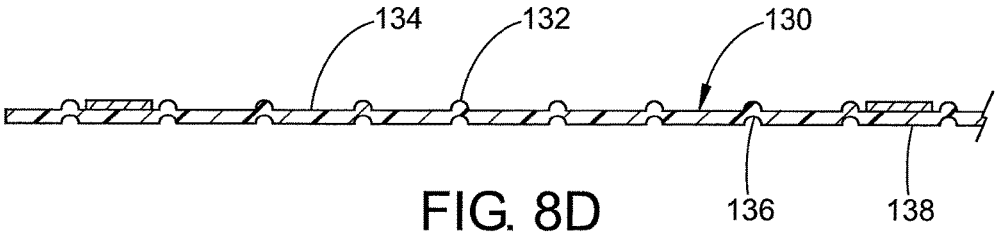
Figure 8E:
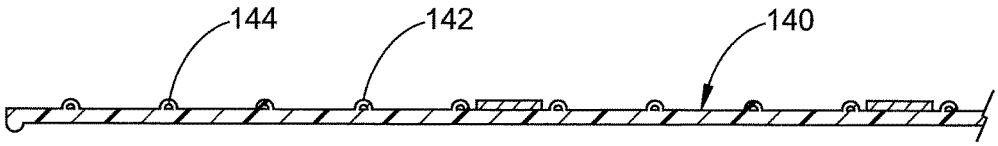

FIG. 8B illustrates a band 110 on which are provided protrusions or ribs that are triangularly shaped as at 112. FIG. 8C illustrates a design in which a band 120 is provided with square ribs 122. FIG. 8D illustrates a design in which a band 130 is provided with semicircular ribs 132 located on an outer surface 134 of the band. In this embodiment, depressions 136 are provided on an inner surface 138 of the band 130. Thus, in this design, the band 130 maintains a generally constant thickness because the grooves 136 are located beneath the protrusions 132. With reference now to FIG. 8E, disclosed in it is a band 140 on which are disposed a plurality of spaced protrusions 142. The protrusions 142 can be approximately semicircular in shape but the protrusions are defined such that there are provided bores 144 extending longitudinally within the protrusions. The bores 144 extend longitudinally along the base of each protrusion in the embodiment illustrated. As tests have not yet been run concerning the various configurations of the ribs disclosed in FIGS. 7 to 8E, it is unclear as to whether any particular configuration would be more advantageous than another configuration in enhancing the electrical resistivity of the band.

All of the embodiments of the band shown in FIGS. 7 to 8E can be manufactured in a conventional manner, such as by extrusion from a suitable elastomeric compound, such as the EPT material which has been discussed above. Thus, the various forms of ribs can be readily defined on the outer surfaces of the bands in question in a simple and economical manner.

Figure 9:
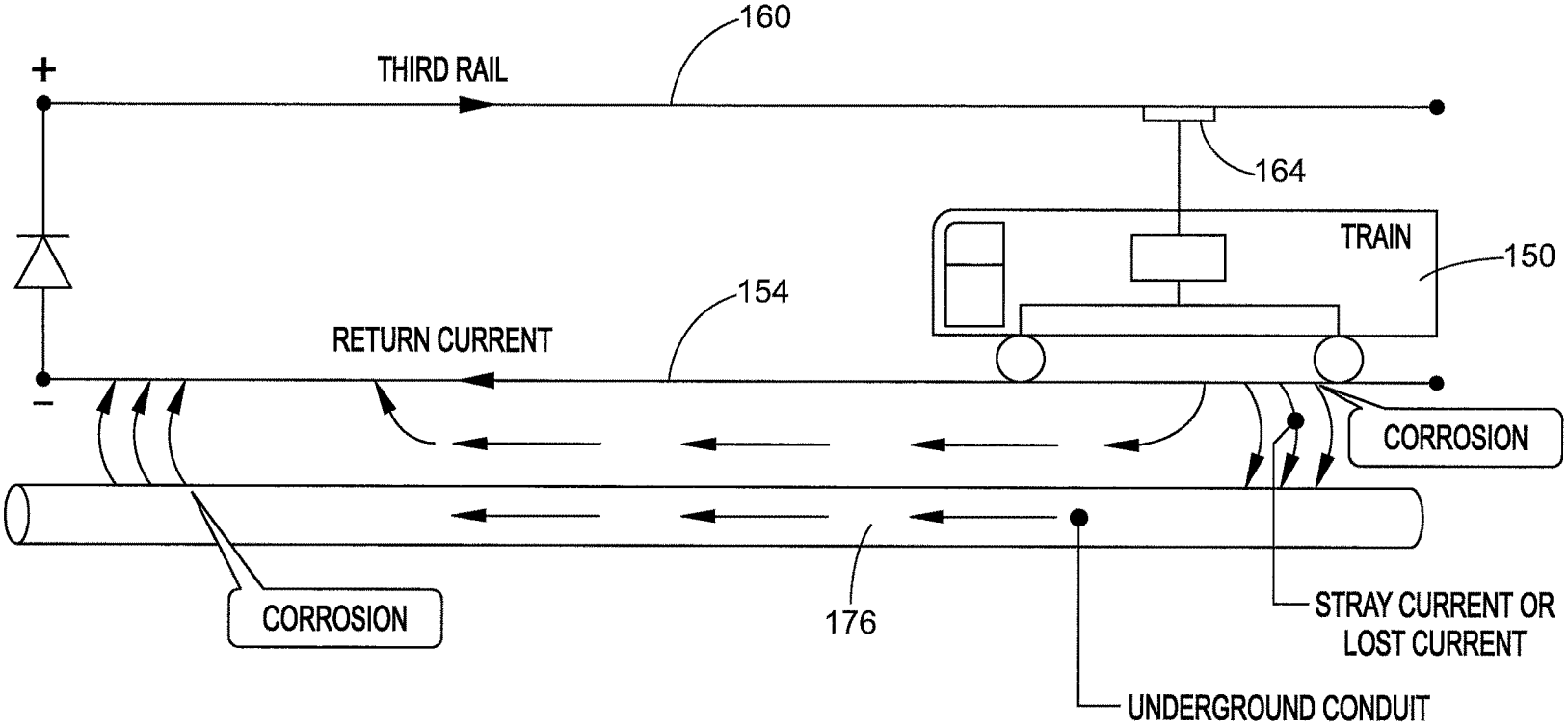
FIG. 9 is a schematic view of stray current flow in a light railway environment.

With reference now to FIG. 9, schematically illustrated is an electrically driven light rail car 150. The car 150 rides on rails 154 (such as the rails illustrated in FIG. 1). The rail car is powered by electricity delivered by a third rail 160 via a contact shoe 164 to power an electric motor 168 disposed in the rail car 150.

A significant problem with such light rail systems is the flow of stray current from the tracks 154 towards the third rail 160. The current will seek a metal conductor such as the underground conduit 176 in the form of a metal pipe or the like along which to flow. Such current flow causes corrosion in the underground conduit. Isolation of the running rails 154 is therefore greatly desired, not only to prevent corrosion in adjacent underground metal pipes and the like, but also to effectively isolate other facilities, such as train controls, wayside equipment and signal systems from current flow.

The designs of the bands illustrated in FIGS. 6-8E utilize various shapes and numbers of raised ribs disposed on the outer surface of the band. These can be arranged in different patterns and spacings, based upon the necessary levels of resistance required and the type of tie, i.e., concrete, plastic or wood employed by the light rail system. In some embodiments, the rib height can be about 50 to 70 percent of the band thickness. The geometry of the rib can be determined based on the stretch required to secure the band around the tie. Round, triangular, or square ribs (see FIGS. 8A to 8E) can provide various levels of dynamic resistance. The size of the rib adds to the resistance of the band itself. In one embodiment, the boot band can have a series of 0.30 inch (0.76 cm) high radially extending ribs disposed on the outer surface of the band. Such a band is designed for the more popular concrete tie that is cast into a concrete invert structure to form the rail track bed.

These ribs provide a surface interruption and increase the surface area of the band thereby increasing the electric resistivity of the band by some percentage. The ribs also provide structural strength to the band as it is stretched around the boot. Thus, the ribs help maintain the effective seal of the band against the tie and boot surfaces. This helps to keep water and contaminants out of the boot pocket supporting a block. As mentioned, the band also provides a significant barrier against stray electrical current.

The instant disclosure has been described with reference to several embodiments. Obviously, modifications and alterations of same will occur to others upon a reading and understanding the preceding detailed description. It is intended that the exemplary embodiments be construed as including all such modifications and alterations insofar as they come within the scope of the appended claims or the equivalents thereof.

The invention claimed is:

1. A rail support device for a ballastless track, the device comprising:

a concrete block including a bottom face and a plurality of side faces;

a tray or sock including a bottom wall, a plurality of side walls and an open upper end, the tray or sock being adapted to hold the bottom face and at least a portion of each of the plurality of side faces of the block;

a band adapted to seal around an upper end of the tray or sock between the tray or sock and the block, the band comprising:

a smooth inner face, an outer face comprising a plurality of spaced longitudinally extending ribs, and wherein the band comprises an electrically insulating elastomeric material.

2. The device of claim 1 wherein the band further comprises at least one marker line.

3. The device of claim 2 wherein the at least one marker line is located between two of the plurality of spaced longitudinally extending ribs.

4. The device of claim 2, wherein the at least one marker line comprises two spaced marker lines extending longitudinally along the band from the first end thereof to the second end thereof.

5. The device of claim 1 wherein the band has a thickness at a location between the ribs of between 0.046 and 0.55 inches.

6. The device of claim 5 wherein the band has a thickness at an apex of a rib of between 0.070 inches to 0.85 inches.

7. The device of claim 1 wherein an elongated body of the band comprises a material which includes an ethylene propylene terpolymer.

8. The device of claim 7 wherein the body further comprises a calcined aluminum silicate filler disposed in the material of the body.

9. The device of claim 8 wherein the band has a volume resistivity of about $1.34\times10^{14}$ Ω*cm.

10. The device of claim 1 wherein a cross-section of at least one of the plurality of ribs of the band is one of triangular, square, and semi-circular.

11. The device of claim 1 wherein a cross-section of at least one of the plurality of ribs of the band includes a bore extending longitudinally through the rib.

* * * * *